US010395818B2

(12) United States Patent
Iizuka et al.

(10) Patent No.: US 10,395,818 B2
(45) Date of Patent: Aug. 27, 2019

(54) NOISE FILTER AND NOISE REDUCTION UNIT

(71) Applicants: Yazaki Corporation, Tokyo (JP); TOYOTA JIDOSHA KABUSHIKI KAISHA, Toyota-shi, Aichi-ken (JP)

(72) Inventors: Hayato Iizuka, Kakegawa (JP); Kazuma Kayo, Kakegawa (JP); Hiroshi Aihara, Toyota (JP)

(73) Assignees: YAZAKI CORPORATION, Tokyo (JP); TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 16/017,318

(22) Filed: Jun. 25, 2018

(65) Prior Publication Data

US 2018/0374635 A1 Dec. 27, 2018

(30) Foreign Application Priority Data

Jun. 27, 2017 (JP) ..... 2017-125389

(51) Int. Cl.
*H01F 27/33* (2006.01)
*H01F 17/06* (2006.01)
(Continued)

(52) U.S. Cl.
CPC ..... *H01F 27/33* (2013.01); *H01B 7/0045* (2013.01); *H01F 17/04* (2013.01); *H01F 17/06* (2013.01);
(Continued)

(58) Field of Classification Search
CPC ..... H01F 27/33; H01F 17/06; H01F 27/266; H01B 7/0045
(Continued)

(56) References Cited

U.S. PATENT DOCUMENTS 5,343,184 A 8/1994 Matsui et al.
6,144,277 A 11/2000 Matsui et al.
(Continued)

FOREIGN PATENT DOCUMENTS

DE 10 2016 224 798 A1 6/2017
EP 2 455 951 A1 5/2012
(Continued)

OTHER PUBLICATIONS

Communication dated Nov. 7, 2018, issued by the European Patent Office in counterpart European Application No. 18180151.5.
(Continued)

*Primary Examiner* — Timothy J Thompson
*Assistant Examiner* — Charles Pizzuto
(74) *Attorney, Agent, or Firm* — Sughrue Mion, PLLC

(57) ABSTRACT

A noise filter (10) is equipped with plural conductors (20) having respective winding portions (21) and a ring-shaped core which is inserted through the winding portions of the plural conductors and made of a magnetic material. The ring-shaped core has a core main body (40) having a pair of extension portions (41) and (42) that are connected to each other at one end and a link core (50) which is attached to the core main body at the other end and thereby connects the extension portions and. At least one of the extension portions and of the core main body is straight. The plural conductors are arranged in a row in a state that the straight extension portion is inserted through the winding portions of the plural conductors.

4 Claims, 6 Drawing Sheets

(51) Int. Cl.

| | |
|---|---|
| ***H01B 7/00*** | (2006.01) |
| ***H01F 27/26*** | (2006.01) |
| ***H01F 17/04*** | (2006.01) |
| ***H01F 27/24*** | (2006.01) |

(52) U.S. Cl.
CPC ..... *H01F 27/24* (2013.01); *H01F 27/266* (2013.01); *H01F 2017/065* (2013.01)

(58) Field of Classification Search
USPC ..... 174/72 A
See application file for complete search history.

(56) References Cited

U.S. PATENT DOCUMENTS

| | | | | |
|---|---|---|---|---|
| 2008/0009193 | A1 | 1/2008 | Kuo | |
| 2013/0229254 | A1* | 9/2013 | Lee | H01F 27/263 336/220 |
| 2014/0345937 | A1 | 11/2014 | Wu et al. | |
| 2015/0008989 | A1* | 1/2015 | Aizawa | H03H 1/0007 333/185 |
| 2017/0174152 | A1 | 6/2017 | Yamaguchi et al. | |
| 2018/0047497 | A1* | 2/2018 | Miyakawa | H01F 17/06 |
| 2018/0233268 | A1 | 8/2018 | Sakai et al. | |

FOREIGN PATENT DOCUMENTS

| | | | |
|---|---|---|---|
| EP | 2 750 150 | A1 | 7/2014 |
| JP | 49003127 | A | 1/1974 |
| JP | 56-9707 | U | 1/1981 |
| JP | 61136311 | A | 6/1986 |
| JP | 3-3209 | A | 1/1991 |
| JP | 3171604 | A | 7/1991 |
| JP | 5299273 | A | 11/1993 |
| JP | 6196335 | A | 7/1994 |
| JP | 11261255 | A | 9/1999 |
| JP | 2009105365 | A | 5/2009 |
| JP | 4369167 | B2 | 11/2009 |
| JP | 2017112064 | A | 6/2017 |
| WO | 2010/067414 | A1 | 6/2010 |
| WO | 2016052257 | A1 | 7/2016 |
| WO | WO 2016163130 | A1 * | 10/2016 |

OTHER PUBLICATIONS

Notice of Reasons for Refusal, dated Jun. 25, 2019, issued in corresponding JP Application No. 2017-125389, 7 pages in English and Japanese.

* cited by examiner

NOISE FILTER AND NOISE REDUCTION UNIT

CROSS-REFERENCES TO RELATED APPLICATION(S)

This application is based on and claims priority from Japanese Patent Application No. 2017-125389 filed on Jun. 27, 2017, and the entire contents of which are incorporated herein by reference.

BACKGROUND

The present invention relates to a noise filter and a noise reduction unit.

Noise filters for reducing noise such as a surge current flowing through an electric wire has been used so as to be equipped with a ring-shaped core that is a circular magnetic body having an insertion hole through which an electric wire is inserted and in which the ring-shaped core is a combination of a pair of divisional core.

As for details of the above mounting structure, refer to JP 4,369,167 B.

SUMMARY

The above ring-shaped core requires cumbersome assembling work of setting an electric wire in a groove of one divisional core and then placing the other divisional core on the one divisional core to form a closed ring-shaped structure. Thus, in particular, in reducing, collectively, noise occurring in plural electric wires attached to the ring-shaped core, work of attaching the electric wires is made even complex; increase in the efficiency of such wires attaching work is desired.

In the above ring-shaped core, if a positional deviation exists between the divisional cores, the sectional area of the ring-shaped magnetic path decreases at joining portions. As a result, the impedance characteristic lowers due to decrease of the magnetic flus passing through the magnetic path, resulting in lowering of the noise reducing effect.

In addition, it is difficult to install the circular ring-shaped core in a narrow space because of its large height.

An object of the invention is therefore to provide a noise filter that exhibits a good noise reducing effect, is superior in the efficiency of assembling work, and can be installed in a narrow space as well as a noise reduction unit that is equipped with such a noise filter.

Embodiments of the present invention provide the following items (1) to (5).

(1) A noise filter comprising:
- a plurality of conductors each having a winding portion; and
- a ring-shaped core inserted made from a magnetic material and being inserted through the winding portions,
- that the ring-shaped core including: a core main body having a pair of extension portions connected to each other at one end; and a link core attached to the core main body at the other end to connect the extension portions,
- at least one of the extension portions of the core main body having a straight shape, and
- the plurality of conductors being arranged in a row to allow the extension portion having the straight shape to be inserted through the winding portion of each of the plurality of conductors.

(2) The noise filter according to item (1), wherein
- the link core includes: a fitting plate portion fitted between respective end portions of the extension portions of the core main body; and a positioning plate portion contacting the extension portions when the fitting plate portion is fitted between the end portions of the extension portions.

(3) The noise filter according to item (1), wherein
- the link core includes a fitting plate portion fitted between respective end portions of the extension portions of the core main body.

(4) The noise filter according to any one of item (1) to item (3), wherein
- the link core is fixed to the core main body at the other end by using a magnetic adhesive member.

(5) A noise reduction unit comprising:
- the noise filter according to any one of item (1) to item (4);
- a housing holding the noise filter; and
- an electric wire of a wire harness introduced into the housing and electrically connected to at least one of the plurality of conductors of the noise filter.

According to first aspect of the invention, relating to the item (1), the straight extension portion of the core main body to which the link core has not been attached yet is inserted through the winding portions of the plural conductors. In this manner, the plural conductors can be attached easily to the core main body of the ring-shaped core, which means increase in the efficiency of assembling work. The ring-shaped core having a continuous, ring-shaped magnetic path can be formed easily by attaching the link core to the core main body (at its open end) to which the conductors have been attached; a good noise reducing effect can be obtained.

Furthermore, since the conductors are arranged in a row along the straight extension portion, the noise filter can be made low in height and hence installed in a narrow space. In addition, since the extension portions which are connected to each other at the one end are connected to each other at the other end by attaching the link core to the core main body there, the noise filter can be made stronger than a noise filter in which divisional cores are prone to separate from each other as in a ring-shaped core that is a combination of divisional half cores.

According to second or third aspect of the invention, relating to the item (2) or item (3), since the fitting plate portion is fitted between end portions of the extension portions of the core main body at its other end, a continuous, ring-shaped magnetic path can be formed reliably by filling the gap between the extension portions and a good noise reducing effect can thereby be obtained. Furthermore, since the fitting plate portion is fitted between end portions of the extension portions and the positioning plate portion is brought into contact with the extension portions, the fitting plate portion can be positioned easily at the prescribed position.

According to fourth aspect of the invention, relating to the item (4), by fixing the link core to the core main body by the magnetic adhesive member, a continuous, ring-shaped magnetic path can be formed reliably and a good noise reducing effect can thereby be obtained.

According to fifth aspect of the invention, relating to the item (5), when it is inserted between, for example, wires, extending from an inverter and a motor, of a wire harness, noise that is generated by high-speed switching in the inverter can be reduced satisfactorily. Since the noise filter which is low in height is housed in the housing, the noise reduction unit is reduced in height and hence can be installed in a narrow space. For example, the noise reduction unit which is connected to a wire harness of a vehicle or the like at its halfway position can be fixed to a floor panel of the vehicle. Furthermore, the noise filter having the ring-shaped core made of a magnetic material can be protected by the housing.

Advantages of the Invention

According to the invention, it is possible to provide a noise filter that exhibits a good noise reducing effect, is superior in the efficiency of assembling work, and can be installed in a narrow space as well as a noise reduction unit that is equipped with such a noise filter.

The invention has been described above concisely. The details of the invention will become more apparent when the modes for carrying out the invention (hereinafter referred to as an embodiment) described below are read through with reference to the accompanying drawings.

DETAILED DESCRIPTION

Embodiment

Figure 1:
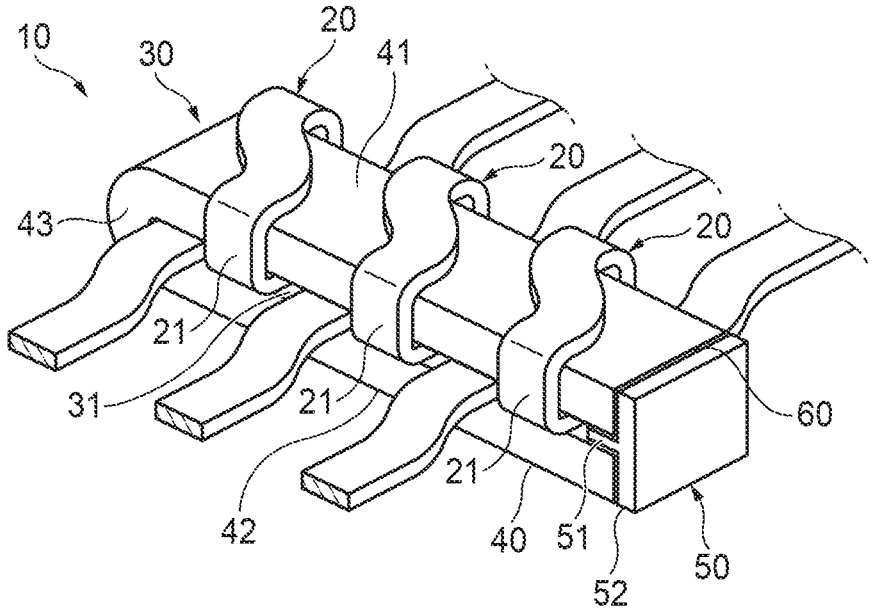
FIG. 1 is a perspective view of a noise filter according to an embodiment of the present invention.
Figure 2:
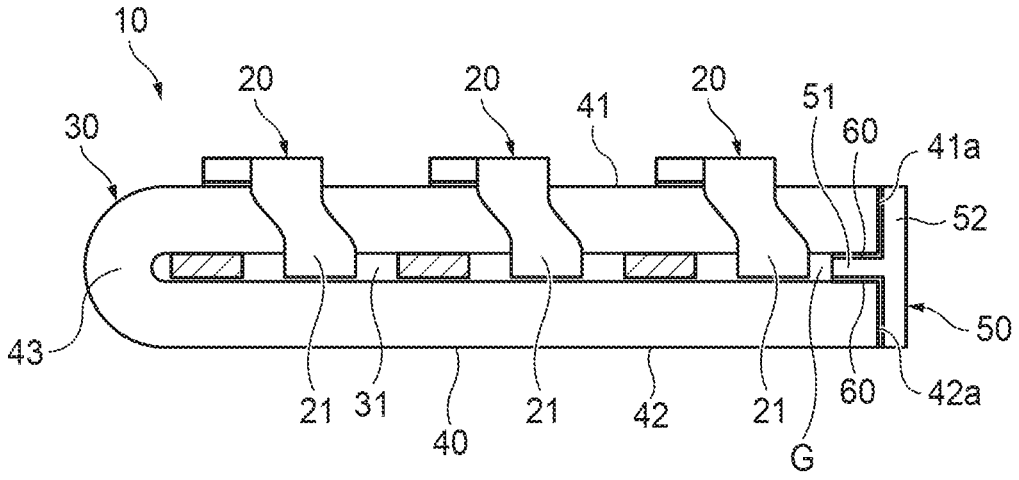
FIG. 2 is a side view of the noise filter according to the embodiment.

An embodiment of the present invention will be hereinafter described with reference to the drawings. FIG. 1 is a perspective view of a noise filter 10 according to the embodiment. FIG. 2 is a side view of the noise filter 10 according to the embodiment.

As shown in FIGS. 1 and 2, the noise filter 10 has plural (in this example, three) conductors 20 and a ring-shaped core 30. For example, the noise filter 10 is provided for a wire harness that connects an inverter and a motor of an electric vehicle, a hybrid car, or the like. The inverter converts a DC voltage of a power source such as a battery into an AC voltage and thereby drives the motor for rotating wheels. Since the inverter converts a DC voltage into an AC voltage by high-speed switching, a high-frequency surge current generated by the switching may flow into the motor which is a load. Provided in the wire harness that connects the inverter and the motor, the noise filter 10 reduces noise generated by the switching.

Originally, the conductors 20 are flat-plate-like busbars produced by, for example, punching a conductive metal plate into strips. A middle portion of each conductor 20 is made a ring-shaped winding portion 21 that is formed by, for example, bending so as to project upward. The winding portion 21 is inclined in a plan view, whereby end portions of the winding portion 21 are deviated (i.e., spaced) from each other in a plan view so as not to be in contact with each other.

For example, the ring-shaped core 30 is made of a magnetic material such as ferrite. The ring-shaped core 30 is shaped like a flat ring having an insertion passage 31 which is an elliptical hole. The insertion passage 31 of the ring-shaped core 30 is a little greater in height than the thickness of the conductors 20.

The ring-shaped core 30 is composed of a core main body 40 and a link core 50. The core main body 40 is formed by connecting a pair of straight extension portions 41 and 42 at one end by an arc-shaped link portion 43 and thus assumes a U shape in a side view. At the other end, the straight extension portions 41 and 42 are not connected to each other but a gap G is formed between them. The length of gap G is the same as the height of the insertion passage 31 of the ring-shaped core 30. End faces 41*a* and 42*a* of the respective extension portions 41 and 42 at the other end of the core main body 40 are flat surfaces that are perpendicular to the longitudinal direction.

The top extension portion 41 of the core main body 40 is inserted through the winding portions 21 of the plural conductors 20, whereby the winding portions 21 of the plural conductors 20 are arranged in a row along the top extension portion 41. The end portions of the winding portion 21 of each conductor 20 that is wound on the top extension portion 41 are inserted through the insertion passage 31.

The link core 50 has a fitting plate portion 51 and a positioning plate portion 52, and has the same width as the core main body 40. The fitting plate portion 51 is slightly thinner than the gap G between the extension portions 41 and 42 of the core main body 40, and projects perpendicularly from one surface of the positioning plate portion 52. The link core 50 is attached to the core main body 40 in such a manner that the fitting plate portion 51 is fitted between respective end portions of the extension portions 41 and 42 (i.e., placed in their gap G) and that the positioning plate portion 52 is in contact with the end faces 41*a* and 42*a* of the extension portions 41 and 42. In this manner, the extension portions 41 and 42 of the core main body 40 are connected to each other at its other end by the link core 50.

The core main body 40 and the link core 50 are bonded to each other with a magnetic adhesive member 60 which is in paste or sheet form and is provided between the core main body 40 and the link core 50. The adhesive member 60 is given magnetism by containing a magnetic material such as a ferrite powder. In this manner, a ring-shaped magnetic path is formed in the ring-shaped core 30 by the core main body 40 and the link core 50 which is fixed to the core main body 40 by the adhesive member 60.

Figure 3:
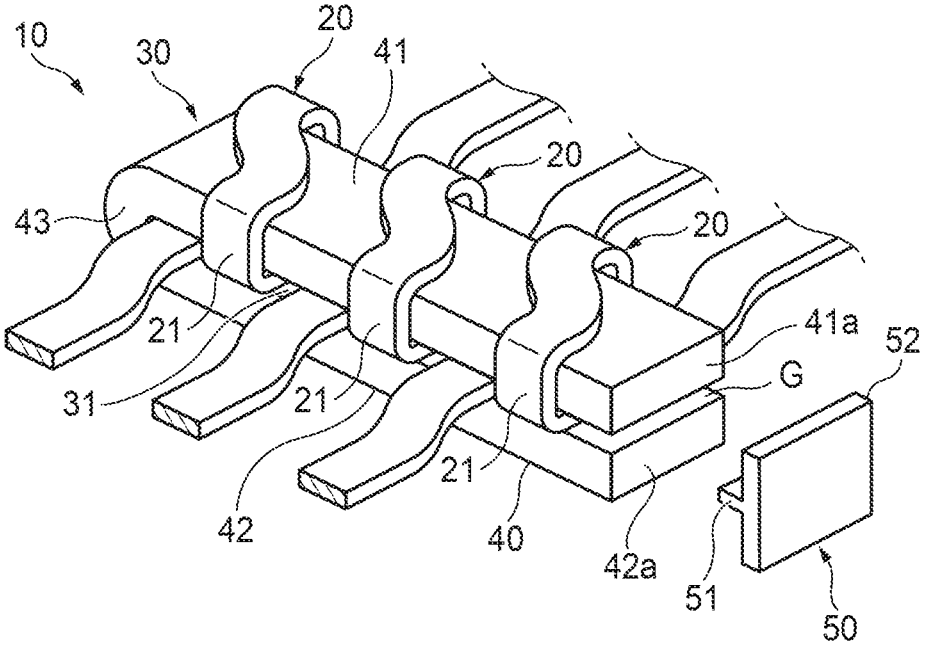
FIG. 3 is an exploded perspective view of the noise filter according to the embodiment.

Next, how to assemble the noise filter 10 which is configured as described above will be described below briefly. FIG. 3 is an exploded perspective view of the noise filter 10 according to the embodiment.

To assemble the noise filter 10, first, plural conductors 20 having respective winding portions 21 are prepared.

Then, as shown in FIG. 3, the plural conductors 20 are attached to the extension portion 41 of the core main body 40 of the ring-shaped core 30. More specifically, the extension portion 41 is inserted into the winding portions 21 of the conductors 20 that are oriented so that the projection portions of the winding portions 21 are located on the top side. As a result, the conductors 20 are wound on the extension portion 41 so as to be arranged in a row.

Subsequently, the fitting plate portion 51 of the link core 50 is inserted into the gap G, the positioning plate portion 52 is brought into contact with the end faces 41*a* and 42*a* of the extension portions 41 and 42, and the link core 50 is fixed to the core main body 40 by the adhesive member 60 that is sandwiched between the core main body 40 and the link core 50.

In this manner, a noise filter 10 is formed in which the plural conductors 20 are attached to the ring-shaped core 30 which is composed of the core main body 40 and the link core 50. The thus-produced noise filter 10 can reduce noise by means of the ring-shaped core 30 having a ring-shaped magnetic path when currents flow through the conductors 20.

As described above, in the noise filter 10 of the embodiment, the straight extension portion 41 of the core main body 40 to which the link core 50 has not been attached yet is inserted through the winding portions 21 of the plural conductors 20. In this manner, the plural conductors 20 can be attached easily to the core main body 40 of the ring-shaped core 30, which means increase in the efficiency of assembling work. The ring-shaped core 30 having a continuous, ring-shaped magnetic path can be formed easily by attaching the link core 50 to the core main body 40 (at its open end (the other end)) to which the conductors 20 have been attached; a good noise reducing effect can be obtained. Furthermore, since the conductors 20 are arranged in a row along the straight extension portion 41, the noise filter 10 can be made low in height and hence installed in a narrow space. In addition, since the extension portions 41 and 42 which are connected to each other at the one end are connected to each other at the other end by attaching the link core 50 to the core main body 40 there, the noise filter 10 can be made stronger than a noise filter in which divisional cores are prone to separate from each other as in a ring-shaped core that is a combination of divisional half cores.

Since the fitting plate portion 51 is fitted between end portions of the extension portions 41 and 42 of the core main body 40 at its other end, a continuous, ring-shaped magnetic path can be formed reliably by filling the gap G between the extension portions 41 and 42 and a good noise reducing effect can thereby be obtained. Furthermore, since the fitting plate portion 51 is fitted between end portions G of the extension portions 41 and 42 and the positioning plate portion 52 is brought into contact with the extension portions 41 and 42, the fitting plate portion 51 can be positioned easily at the prescribed position.

By fixing the link core 50 to the core main body 40 by the magnetic adhesive member 60, a continuous, ring-shaped magnetic path can be formed reliably and a good noise reducing effect can thereby be obtained.

The conductors 20 of the noise filter 10 are not limited to busbars, the conductors 20 may be, for example, insulated electric wires in each of which a core wire is covered with an outer sheath.

It suffices that at least the top extension portion 41, inserted through the winding portions 21 of the conductors 20, of the core main body 40 be straight; the bottom extension portion 42 need not always be straight and may be curved, for example.

Figure 4:
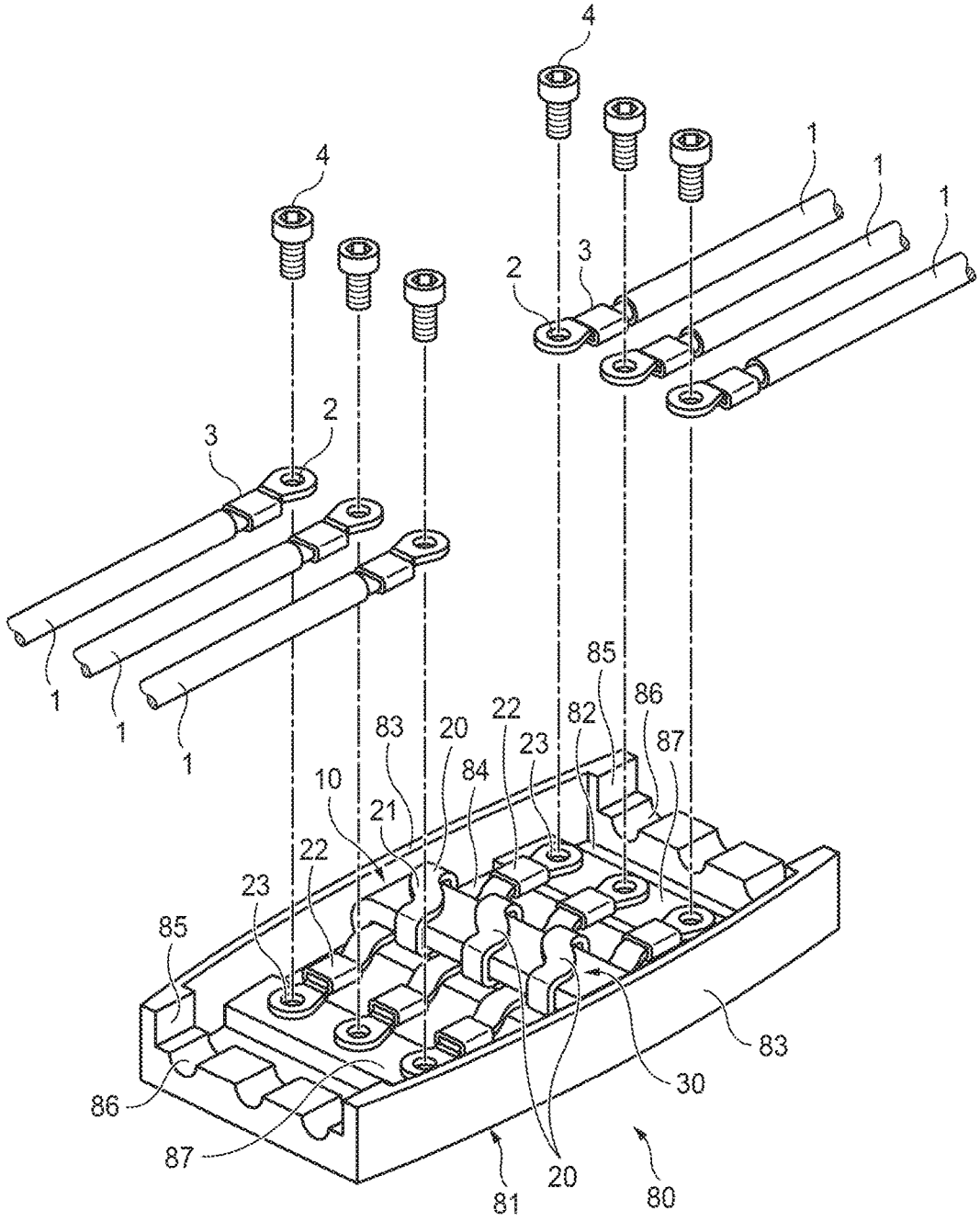
FIG. 4 is a perspective view of a noise reduction unit that is equipped with the noise filter according to the embodiment.

Next, a noise reduction unit 80 which is equipped with the above-described noise filter 10 will be described. FIG. 4 is a perspective view of the noise reduction unit 80 which is equipped with the noise filter 10.

As shown in FIG. 4, the noise reduction unit 80 is equipped with a housing 81 which houses the noise filter 10.

The housing 81 is made of an insulative synthetic resin and has a bottom plate 82 and side walls 83 which are erected from the bottom plate 82 at its two respective sides. The housing 81 is shaped like a rectangular box having a housing space that is open at the top. A central portion of the bottom plate 82 is a core holding portion 84 which defines a central portion of the housing space in which to set the noise filter 10. Terminals 22 are fixed to two respective end portions of each conductor 20 of the noise filter 10 which is housed in the housing 81. Each terminal 22 has a bolt insertion hole 23 and is fixed to the associated conductor 20 by, for example, crimping and thereby connected to it electrically.

The housing 81 has wire introduction portions 85 at the two respective ends in the longitudinal direction, and wires 1 of a wire harness are introduced from the wire introduction portions 85. Each wire introduction portion 85 is formed with U-shaped wire holding grooves 86. The bottom plate 82 is formed with terminal stages 87 between the core holding portion 84 and the wire introduction portions 85. Insert nuts (not shown) are buried in the terminal stages 87 by insert molding, for example. The terminals 22 which are fixed to the conductors 20 of the noise filter 10 are placed on top of the terminal stages 87, more specifically, over the respective insert nuts.

The wires 1, extending from an inverter and a motor, of the wire harness are connected to the above-configured noise reduction unit 80. A terminal 3 having a bolt insertion hole 2 at one end is connected to each wire 1. Each wire 1 is introduced through a wire introduction portion 85 of the housing 81 and is set and held in a wire holding groove 86. The terminal 3 of each wire 1 is placed on the terminal 22 of the corresponding conductor 20 that is placed on top of the associated terminal stage 87, whereby the bolt insertion holes 2 and 23 communicate with each other. A bolt 4 is inserted into these bolt insertion holes 2 and 23 and screwed into the associated insert nut of the terminal stage 87, whereby the terminal 3 of the wire 1 and the terminal 22 of the conductor 20 of the noise filter 10 are fastened to the terminal stage 87 and electrically connected to each other. In this manner, the wires 1, extending from the inverter and the motor, of the wire harness are connected to the noise reduction unit 80 and noise generated by high-speed switching in the inverter can be reduced by the noise filter 10 of the noise reduction unit 80.

According to the above-described noise reduction unit 80 having the noise filter 10, when it is inserted between, for example, wires 1, extending from an inverter and a motor, of a wire harness, noise that is generated by high-speed switching in the inverter can be reduced satisfactorily. Since the noise filter 10 which is low in height is housed in the housing 81, the noise reduction unit 80 is reduced in height and hence can be installed in a narrow space. For example, the noise reduction unit 80 which is connected to a wire harness of a vehicle or the like at its halfway position can be fixed to a floor panel of the vehicle. Furthermore, the noise filter 10 having the ring-shaped core 30 made of a magnetic material can be protected by the housing 81.

A sealing material (not shown) which is a synthetic resin such as an epoxy resin is charged into the housing 81 of the noise reduction unit 80. By charging the sealing material into the housing 81 in this manner, the noise filter 10 having the ring-shaped core 30 made of a magnetic material can be fixed and protected reliably and can be increased in impact resistance. And the noise reduction unit 80 can be miniaturized because it no longer requires a complex waterproof structure. The waterproofness of the noise reduction unit 80 can be made even so high that it can be installed outside the vehicle body by putting a lid on top of the housing 81.

Other Embodiments

The invention is not limited to the above embodiment and various modifications, improvements, etc. can be made as appropriate. The materials, shapes, sets of dimensions, numbers, locations, etc. of the respective constituent elements of the above embodiment are not limited to those disclosed but can be determined in desired manners as long as the invention can be implemented.

Figure 5:
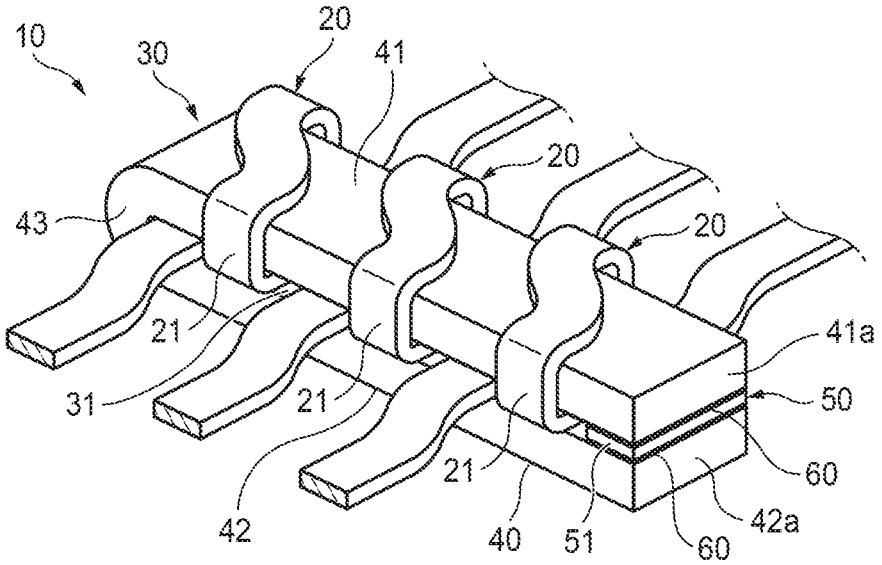
FIG. 5 is a perspective view of a noise filter according to a modification.
Figure 6:
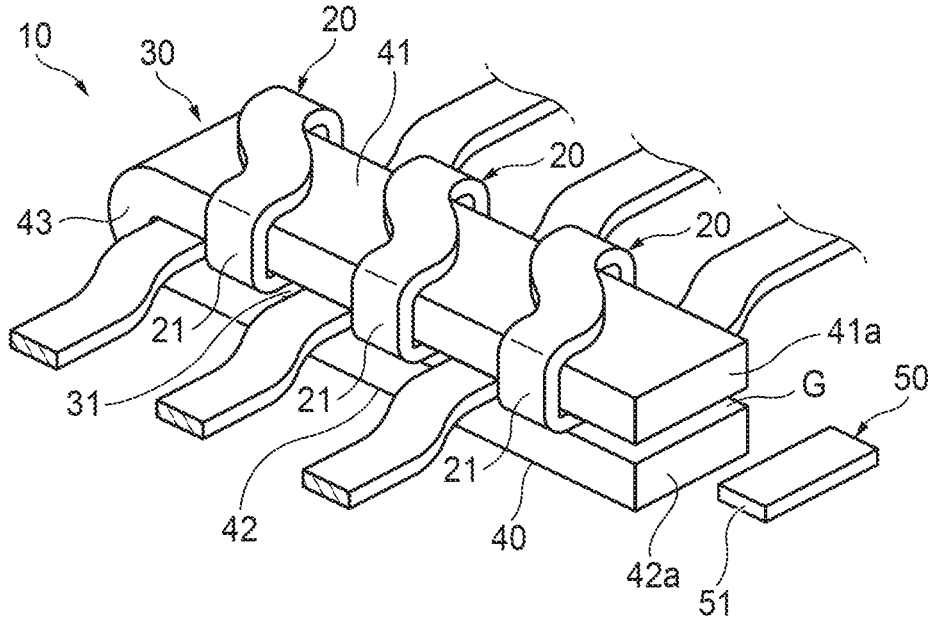
FIG. 6 is an exploded perspective view of the noise filter according to the modification.

For example, the link core of the noise filter 10 is not limited to the link core 50 employed in the above embodiment. A noise filter 10 that is modified in this respect will be described below. FIG. 5 is a perspective view of the noise filter 10 according to the modification. FIG. 6 is an exploded perspective view of the noise filter 10 according to the modification.

As shown in FIGS. 5 and 6, A link core 50 of the noise filter 10 according to the modification does not have the positioning plate portion 52 and has only a fitting plate portion 51. The link core 50, that is, the fitting plate portion 51, is fitted between respective end portions of the extension portions 41 and 42 (i.e., placed in their gap G) and thus attached to the core main body 40. In this manner, the extension portions 41 and 42 of the core main body 40 are connected to each other at its other end by the link core 50, that is, the fitting plate portion 51.

Also in this modification, the link core 50 is bonded to the core main body 40 with an adhesive member 60 which contains a magnetic material, is in paste or sheet form, and is provided between the core main body 40 and the link core 50. In this manner, a ring-shaped magnetic path is formed in the ring-shaped core 30 by the core main body 40 and the link core 50 which is fixed to the core main body 40 by the adhesive member 60.

According to the noise filter 10 of this modification, since the link core 50 has only the fitting plate portion 51 and hence is simple structure, the noise filter 10 can be reduced in cost and the ring-shaped core 30 can be miniaturized.

Features of the above-described noise reduction unit 10 according to the embodiment of the invention will be summarized below concisely as items (1) to (5):

(1) A noise filter (10) comprising:
- a plurality of conductors (20) each having a winding portion (21); and
- a ring-shaped core (30) inserted made from a magnetic material and being inserted through the winding portions (21),
- that the ring-shaped core (30) including: a core main body (40) having a pair of extension portions (41, 42) connected to each other at one end; and a link core (50) attached to the core main body (40) at the other end to connect the extension portions (41, 42),
- at least one of the extension portions (41, 42) of the core main body (40) having a straight shape, and
- the plurality of conductors (20) being arranged in a row to allow the extension portion having the straight shape to be inserted through the winding portion (21) of each of the plurality of conductors (20).

(2) The noise filter (10) according to item (1), wherein
- the link core (50) includes: a fitting plate portion (51) fitted between respective end portions of the extension portions (41, 42) of the core main body (40); and a positioning plate portion (52) contacting the extension portions (41, 42) when the fitting plate portion (51) is fitted between the end portions of the extension portions (41, 42).

(3) The noise filter (10) according to item (1), wherein
- the link core (50) includes a fitting plate portion (51) fitted between respective end portions of the extension portions (41, 42) of the core main body (40).

(4) The noise filter (10) according to any one of item (1) to item (3), wherein
- the link core (50) is fixed to the core main body (40) at the other end by using a magnetic adhesive member (60).

(5) A noise reduction unit comprising:
- the noise filter (10) according to any one of item (1) to item (4);
- a housing holding the noise filter (10); and
- an electric wire of a wire harness introduced into the housing and electrically connected to at least one of the plurality of conductors (20) of the noise filter (10).

REFERENCE SIGNS LIST

1: Wire
10: Noise filter
20: Conductor
21: Winding portion
30: Ring-shaped core
40 Core main body
41, 42: Extension portion
50: Link core
51: Fitting plate portion
52: Positioning plate portion
60: Adhesive member
80: Noise reduction unit
81: Housing

The invention claimed is:

1. A noise filter comprising:
- a plurality of conductors each having a winding portion; and
- a ring-shaped core made from a magnetic material and being inserted through the winding portions, wherein
- the ring-shaped core includes a core main body having a pair of extension portions connected to each other at one end; and a link core attached to the core main body at another end to connect the pair of extension portions,
- at least one of the pair of extension portions of the core main body has a straight shape,
- the plurality of conductors being arranged in a row to allow the extension portion having the straight shape to be inserted through the winding portion of each of the plurality of conductors, and
- the link core includes: a fitting plate portion fitted between respective end portions of the pair of extension portions of the core main body; and a positioning plate portion contacting the pair of extension portions when the fitting plate portion is fitted between the end portions of the pair of extension portions.

2. The noise filter according to claim 1, wherein
- the link core is fixed to the core main body at the another end by using a magnetic adhesive member.

3. A noise reduction unit comprising:
- the noise filter according to claim 1;
- a housing holding the noise filter, and
- an electric wire of a wire harness introduced into the housing and electrically connected to at least one of the plurality of conductors of the noise filter.

4. A noise filter comprising:
- a plurality of conductors each having a winding portion; and
- a ring-shaped core made from a magnetic material and being inserted through the winding portions, wherein
- the ring-shaped core includes a core main body having a pair of extension portions connected to each other at one end; and a link core attached to the core main body at another end to connect the pair of extension portions, at least one of the pair of extension portions of the core main body has a straight shape, the plurality of conductors being arranged in a row to allow the extension portion having the straight shape to be inserted through the winding portion of each of the plurality of conductors, and the link core includes a fitting plate portion fitted between respective end portions of the pair of extension portions of the core main body.

* * * * *